United States Patent [19]

Bellasio et al.

[11] 4,316,378

[45] Feb. 23, 1982

[54] EXTRUSION PRESS WITH METHOD AND APPARATUS FOR REMOVING UNUSED METAL FROM EXTRUDER PISTON

[75] Inventors: Aldo Bellasio, Milan; Giulio Brusa, Monza, both of Italy

[73] Assignee: Industrie Pirelli Societa per Azioni, Milan, Italy

[21] Appl. No.: 162,391

[22] Filed: Jun. 24, 1980

[30] Foreign Application Priority Data

Jun. 29, 1979 [IT] Italy ..... 23965 A/79

[51] Int. Cl.[3] ..... B21C 23/26; B21C 23/30; B21C 35/04

[52] U.S. Cl. ..... 72/268; 72/254; 29/239

[58] Field of Search ..... 72/253.1, 254, 255, 72/268, 344, 427; 29/239

[56] References Cited

U.S. PATENT DOCUMENTS

| | | | |
|---|---|---|---|
| 1,550,301 | 8/1925 | Yungling | 29/239 |
| 2,924,332 | 2/1960 | Lawton et al. | 72/268 |
| 2,954,869 | 10/1960 | Swanson | 72/255 |
| 3,406,554 | 10/1968 | Frankenberg | 72/344 |

FOREIGN PATENT DOCUMENTS

| | | | |
|---|---|---|---|
| 629007 | 9/1949 | United Kingdom | 72/344 |
| 893299 | 4/1962 | United Kingdom | 72/254 |

*Primary Examiner*—Lowell A. Larson

*Attorney, Agent, or Firm*—Brooks, Haidt, Haffner & Delahunty

[57] ABSTRACT

Apparatus and method for removing a metal collar from the lower portion of the piston of a metal extrusion press which may be attached to the press. A pivotally mounted frame has a portion which can be moved toward and away from the piston while it is retracted from the metal container and the frame carries two cutting knives and two divaricating members disposed alternately around the piston axis. Each knife and each divaricating means is movable parallel to the axis of the piston and radially outwardly of the piston by a pair of pivotally interconnected fluid-actuable, cylinder and piston assemblies. The frame may also carry apparatus for loading container sealing discs on the press metal container and may be in the form of a cage with an openable side.

19 Claims, 5 Drawing Figures

EXTRUSION PRESS WITH METHOD AND APPARATUS FOR REMOVING UNUSED METAL FROM EXTRUDER PISTON

The present invention relates to improvements in extrusion presses. More particularly, it refers to improvements in a press used for extruding a metallic layer around an elongated body, a tube, a conductor etc., that is continuously in motion in the direction of its own axis, for example, for the purpose of providing a protective metal layer around the body, or for covering an electric cable with a sheath of aluminum or some other similar material.

These presses substantially comprise: an upper piston, a lower piston, a container having an intermediate chamber to be filled with the material to be extruded, and a mobile block through which the elongated body passes to be clad with a sheath. The container automatically receives, at its inside, an already pre-heated, cylindrical billet of the material to be extruded, and it has, at its upper part a frusto-conical seat on which, immediately above the billet, there is disposed a disc functioning as a sealing closure, the disc being of the same material as the material to be extruded and being at ambient temperature. This disc serves for hermetically closing the space between the upper and the lower parts of the container in such a way as to permit the complete evacuation of any existing air by means of a special pump.

In this manner, when the upper piston descends towards the container, there is had firstly, the drawing of the disc, and then, the compression of the billet and the consequent urging of the material towards the intermediate filling chamber and the extrusion block where the moving elongated body is covered with a sheath. This operation takes place in the absence of oxidation phenomena because of the vacuum previously created in the container, for which reason, during the said descent of the upper piston, the disc bonds perfectly with the billet and then becomes part of the material to be extruded around the elongated body.

The press functions in a continuous manner, even when the upper piston is extracted from the container, since the mobile block ascends towards the second piston and extrudes the material remaining in the intermediate chamber of the container.

In the presses described, the descent of the upper piston causes an undesired drawing of material in the direction opposite to the actual flow direction. When the piston is extracted from the container, the drawn material, which is no longer restricted by the inner wall of the container, nor even by the thrusting end of the piston, expands because of being in a plastic state and assumes the form of a collar with its lower lateral wall having a thickness of about 0.2 mm. and adheres, for a certain amount of movement, to the pushing-end of the piston. Such end has a diameter which is substantially equal to that of the container, and the collar has lateral upper walls having a maximum thickness of about 4–5 mm, being around and spaced from the piston end which has a lesser diameter.

As the press operations proceed, should the collar not be removed, there takes place a superimposing of several collars, since the press functions over quite long periods when having to cover elongated bodies of considerable lengths. This circumstance produces an adverse result because the various collars tend to cool and to harden, and consequently, their removal becomes more difficult.

For preventing this drawback, each collar may be removed manually after every work cycle, or through employing mechanical systems. Nevertheless, since the press extrudes continuously and the removal of the collar must take place while the piston is extracted from the container, there is the problem of having to operate within the limits of quite a short period of time. Furthermore, there exists the risk of damaging, when a knife edge or some such similar means is used, the terminal, pushing-end of the piston itself.

Moreover, other drawbacks are encountered, such as, for example, physical risks to the health and well-being of the operator who is obliged to carry out his work, during the various and frequent work cycles, inside an ambient where the temperature is quite high (400°–450° C. for example, when extruding aluminum), and in a contaminated atmosphere due to the treatment to which the material being extruded is subjected. Also, the operator must work in close proximity to the mechanism, with the possibility of having movements according to pre-determined, very rapid sequences.

Unfortunately, up to the time of this invention, no satisfactory solutions to the problems exist. Therefore, one object of this invention is to provide a method and apparatus that is adopted to remove the said collar from the piston of an extruding press which will overcome the problems and drawbacks previously described.

One object of this invention, is a method for removing a metallic collar disposed around the lower end of the piston of an extruding press, said piston being pushed within a special container for extruding metallic material, and said metallic collar being formed during the extruding phase when the metallic material is drawn in the direction opposite to that of the direction of extrusion. Said method is performed during the phase of extracting the piston from the container and is characterized by the following steps:

(a) cutting of at least one portion of the wall of the collar along a vertical plane which contains the piston axis and causing the line of the cut to proceed in the direction from the upper end to the lower end of the piston up to the end of the piston and then, across that space between the inner wall of the collar and piston.

(b) divaricating the collar with divaricating forces which proceed in the direction from the upper end towards the lower end of the piston and up to the end of the piston and then, across that space between the inner collar wall and the piston, and subsequently causing the divaricating forces to act in a radial sense to the piston until the inner transverse size of the collar is wider than the outer maximum diameter at the end of the piston.

Preferably, the process of the invention is characterized by the fact of simultaneously causing the line of cut and the divaricating means to advance, during the steps (a) and (b), along the piston and in the radial sense.

The process is based upon the operation of proceeding to cut and to separate the collar parts by any form of cutting means either during the shifting of said means in the direction from top to bottom of the piston, even with a simple incision in the thickness of the collar, or during the succeeding radial shifting from the inner space comprised between piston and collar towards the outside of the collar.

When executing the two operations described, the first being cutting at least partially into the thickness of the collar or of making an incision with the simultaneous application of the divaricating means, and the second operation of finally cutting the total thickness of the collar and of divaricating it, the time required for removing the collar is shortened, because, apart from the fact of performing the step relative to the descent of the cutting means, (always the first phase), there is produced in the collar thickness a preferential parting line which, for the successive phase of radially shifting the divaricating means, causes an immediate fracture of separation along the line of the cut of the remaining portion of the collar which adheres to the lateral surface of the piston.

In the preferred form of embodiment, the method is characterized by the fact of shifting the said cutting line during the phase (b), in the sense radial to the piston and through the thickness of the collar, and applying forces directly on the two sides determined by the cut, said forces being equal and opposed and adapted to divaricate said sides in such a way as to originate, in each transversal section of the collar, a substantially "V-shaped" opening with the apex of said "V", in each transverse section, having a radially more external position to the piston with respect to the extreme edges and with an area that gradually increases as the cutting line advances radially.

A further object of the invention is apparatus for the removal of a metallic collar disposed around the lower end of the piston of an extrusion press, said piston being pushed into a container for extruding metallic material, and said metallic collar being formed during the drawing of metallic material in the opposite sense to that of the flow-extrusion direction, said apparatus being characterized by the fact of comprising a mobile frame which moves from a stationary position to an operative position in the vicinity of the press when the piston is extracted from the relative container. The frame carries means for cutting the metallic collar around the piston, means for divaricating the collar, a device for connecting each of the said means to the frame and for shifting it in the operative steps along a vertical plane containing the piston axis, and respectively, in a first direction along the external surface of the piston without contact therewith and in a straight line in the direction from the upper extremity of the piston towards the lower extremity up to the inner space between the inner wall of the collar and the piston, and thence, in a second direction radially external to the piston.

Preferably, the apparatus comprises one or more cutting means, each one comprising a knife with an inclined cutting line with respect to the piston axis, and converging towards the piston base, said cutting line being determined by the corner of two flat triangular faces.

In its preferred version, the apparatus comprises one or more divaricating means, each one constituted by a curvilinear thrusting surface in the form of arcs, with the midline inclined with respect to the piston axis and converging towards the piston base.

The present invention can, moreover, permit the use of the apparatus described with further auxiliary systems for the functioning of the press. For example, and in particular, the apparatus may support a group for loading the sealing-discs to be inserted onto the upper part of the container above the billet.

Other objects and advantages of the present invention will be apparent from the following detailed description of the presently preferred embodiments thereof, which description should be considered in conjunction with the accompanying drawings in which.

The invention will be described by making reference to a known type of extruding press that functions continuously, and for illustrating what has been stated in the previous description regarding the functioning of said press, there is illustrated, for example, in FIG. 1, a press comprising an upper piston 1 with a vertical axis, and a lower piston 1', a container C, with an intermediate filling chamber C', and a mobile block M within which an elongated body t passes to be sheathed.

Figure 1:
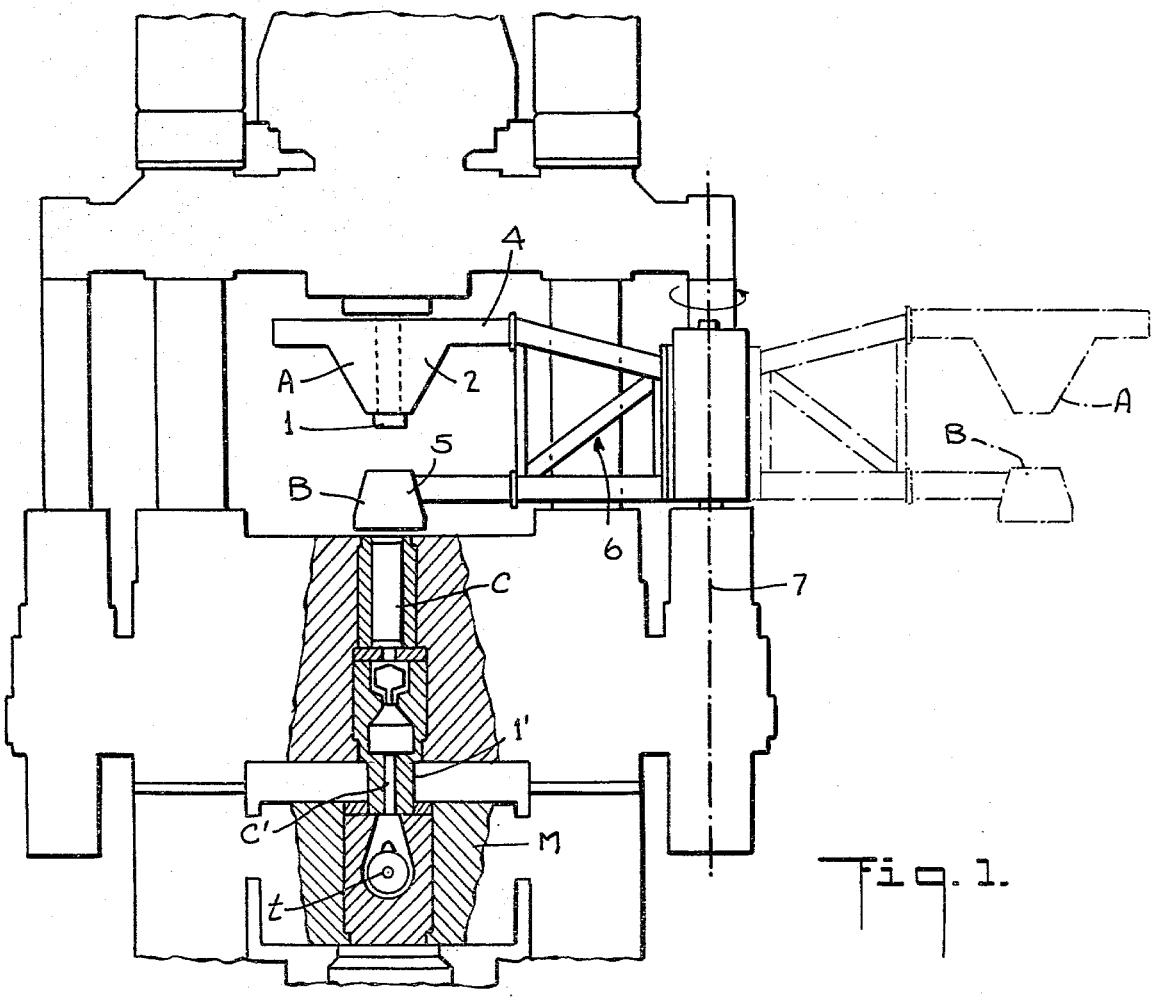
FIG. 1 illustrates diagramatically the apparatus of the invention for removing a collar from a press piston in association with a press and a sealing disc loading group, the broken lines indicating a second position of the loading group when the press piston descends.
Figure 2:
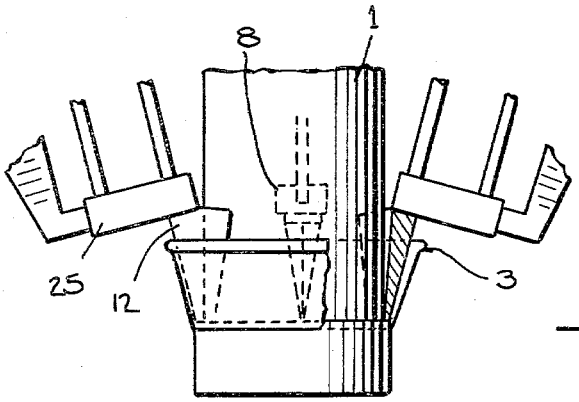
FIG. 2 is a fragmentary, enlarged view of the press piston, a collar therearound and portions of the collar removing apparatus.

For the purpose of our invention, it is important to refer, here in particular, to the press having an upper piston 1 extracted from the container C, and to the apparatus 2 (FIGS. 1 and 3) partly integral with the press, which functions continuously, which is adapted for the automatic removal of a metallic collar 3 (FIG. 2).

For clarifying what has been previously stated, we shall briefly repeat that said collar 3, is formed by being drawn, during the extrusion phase, when the piston 1 compresses the sealing-disc, and hence, the metallic billet inside the container C through the means of mechanical pressure, for extruding the billet in the form of a sheath, around an elongate body t moved continuously in the direction of its own axis, through the mobile block M of the press.

Still, by way of example, reference is made to the use of the apparatus 2 with a press for extruding an aluminum sheath onto an electric power cable. The apparatus 2, is supported by a mobile frame 4 at a stationary spaced position at one side of the press during the extruding phase, and during an operative phase it is in the vicinity of the press at which time the piston 1 is already extracted from the relative container C (FIG. 1).

During this operative phase, the apparatus 2 removes the aluminum collar and then returns to its position at the side of the press during the succeeding descent of the piston into the associated container C. The possibilities for the motions of the apparatus 2 are various, i.e. there can be foreseen a rectilineal shifting of the frame 4 between the two cited positions or even a rotation of the frame 4 around a special axis of rotation parallel to the piston.

In the preferred form of realization of the invention, the apparatus 2 for the removal of the collar 3 is associated with the group 5 which is used for positioning the aluminum sealing-disc on its associated container in such a way as to constitute a single assembly 6 pivotable around a shaft 7 (FIG. 1) from the position shown by a broken-line to the full-line position shown in FIG. 1. However, it is apparent that the apparatus 2 and the group 5 can be associated to two separate structures pivoting around two different axes.

For simplicity's sake, in FIG. 1 the main parts of the assembly 6 have been represented by two outlines distinguished one from the other by the letters A and B. The apparatus designated by the letter A is the apparatus 2 that is shown in detail in FIGS. 3 and 4, and the letter B designates the loading group 5, that is shown in detail in FIG. 5.

The apparatus 2 for the removal of the collar 3 comprises cutting means for cutting the collar 3, each one of these means being constituted by a knife 8 (FIGS. 2 and 3) having its cutting line 9 determined by the corner made by the two flat triangular face 10 and 11, the latter being inclined with respect to the piston axis and converging towards the bottom thereof, means for divaricating the collar 3, each one of which comprises a thrusting surface with a mid-line 13 which is inclined with respect to the piston bottom and converging towards the bottom, devices 14 for connecting each collar 8 and each thrusting surface 12 for divaricating the collar 3 to the frame and for shifting the kinves 8 and the thrusting surface 12, both along the inner surface of the collar 3 as well as in the direction radial of the piston 1. According to the preferred version of the apparatus, the device 14 are all identical to each other, and they will now be described by referring to only one of these said devices relative to the means for divaricating the collar 3.

Figure 3:
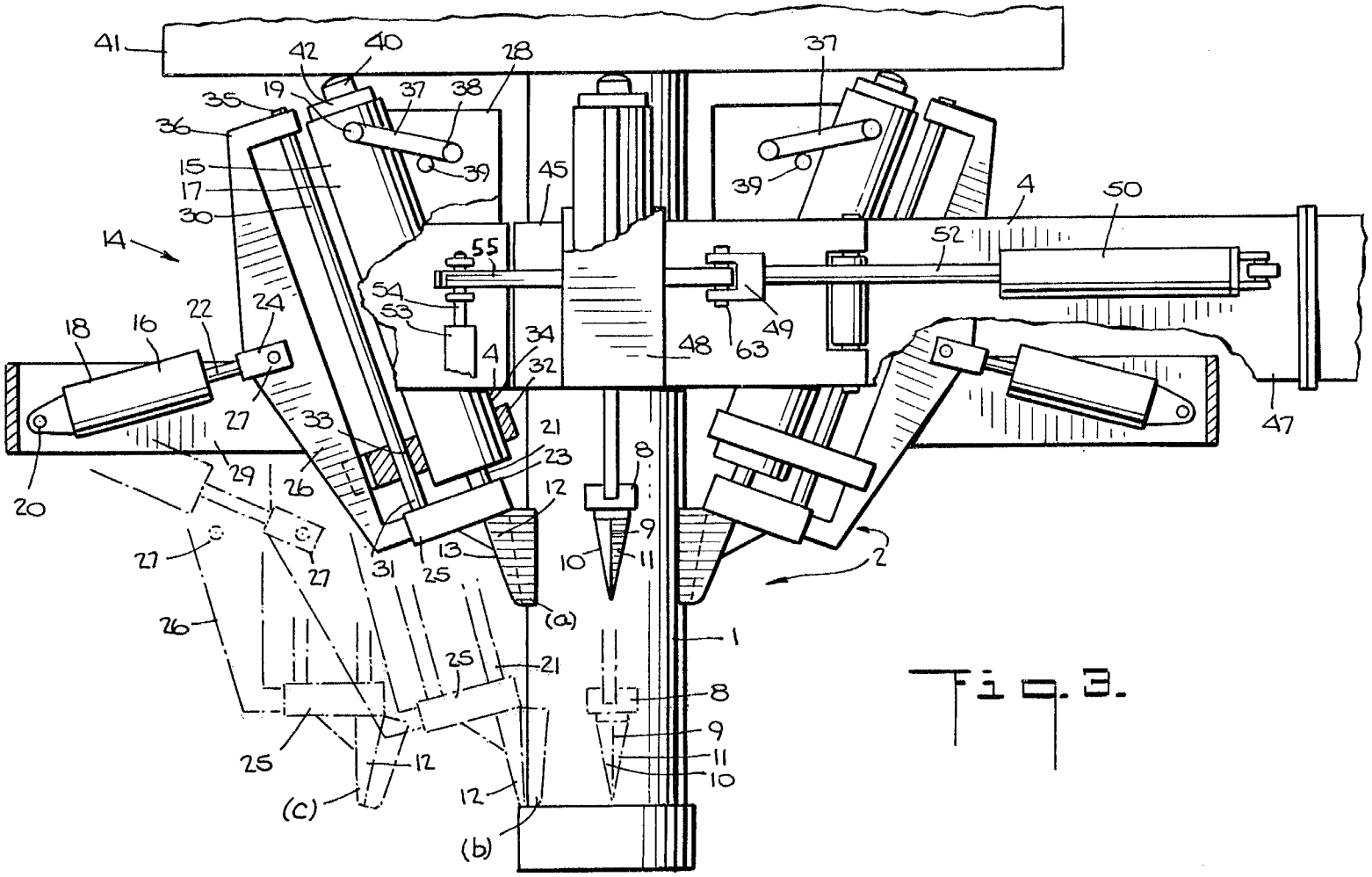
FIG. 3 is a diagrammatic, elevation view similar to FIG. 1 and illustrates, with certain parts removed, the apparatus of the invention for removing a collar.

Said devices 14 comprise, in their more general form, two fluid actuable controls 15 and 16 oriented as in FIG. 3 with their cylinders 17 and 18 pivotally secured to the frame 2 at points 19 and 20, and with their piston rods 21 and 22 having their free extremities 23 and 24, associated with one another in such a way as to be pivoted together in diverse directions for achieving the divarication of the collar 3. In this case, the pivot-connection between the two rods 21 and 22, is realized by means of the special supporting element 25 with its base being rigidly fixed at 90° with respect to the first rod 21. With a special extension 26, the element 25 is also connected by a pivot 27 to the free extremity 24 of the second rod 22.

As can be seen in the at rest position of FIG. 3 (shown by full-line) the device 14 is similar to a system comprising two sides and three pivots, the first side being formed by the cylinder 17 and the rod 21, by the support 25 and by the extension 26; the second side, by the cylinder 18 and the rod 22. In this system, the pivot 27 represents the intermediate connecting means between the two sides, said system being adapted to allow the successive operative movements. The pivots 19 and 20 respectively constitute the means for connecting a first vertical rod 28 parallel to the axis of the piston 1 of the press with a horizontal bar 29 of the frame itself.

The vertical rod 28, the horizontal bar 29 and the pivots 19 and 20 are directed and oriented in such a way as to maintain (when in the at rest position) the cylinder 17 inclined with respect to the press piston axis, when the frame 4 is in the proximity of the piston 1 of press, and the associated divaricating means are, therefore, disposed around and spaced apart from the piston 1 with the mid-line of the thrusting surface 12 having a pre-determined inclination with respect to the piston 1 axis. The second cylinder 18 (in the same at rest position) exerts a thrust upon the extension 26 of the first side of the system, while the divaricating means is maintained as desired.

During the operating steps, the fluid actuation of the controls 15 and 16, the angular shifting of the first cylinder 17 around the pivot 19 and the angular shifting of the second cylinder 18 around the pivot 20, allow, with the sliding of the rods 21 and 22 in their respective cylinders, for the shifting of the divaricating means from the position of the full-line position to that of the broken-line position, in order and in succession, primarily in the direction parallel to the axis of the piston 1 of the press, and thereafter, radially.

Furthermore, the device 14 makes favorable use of special guiding means adapted for maintaining (during the shifting of the rod 21 in the cylinder 17) the mid-plane of the means for divaricating the collar in the same vertical plane which comprises the axis of the press piston 1. In practice, these guiding means maintain the divaricating means in their required orientation—from the idle position to the successive operative position, in such a way as to prevent any rotation of the rod, inside the cylinder in which it slides, from varying the pre-established orientation for the thrusting surface 12 of the divaricating means.

Said guiding means comprise a guiding rod 30, parallel to the axis of the first cylinder 17 and having an extremity 31 connected at 90° to the base of the supporting element 25, and a slab 32 provided with a hole 33 within which the rod 30 can slide. Said slab 32 is secured in fixed relation to the external surface of the first cylinder 17 by means of a circular portion 34. The other extremity 35 of the guiding rod 30 can be, in its turn, connected to a special arm 36 of the extension 26.

When the first cylinder 17 rotates by a certain amount of arc around the pivot 19, the slab 32 rigidly follows the shifting of the supporting element 25 and, in being forced to slide within the hole 33 of slab 32, it controls the correct orientation of the means for divaricating the collar 3.

The device 14, according to a form of preferred embodiment, has a diverse connection to the apparatus, the connection which is chosen especially and advantageously in accordance, with the principle of discharging the reactions received during the operations of divaricating and cutting the collar directly onto the press structure. Through the practical application of this principle, there is obtained an overall lightened weight of the resisting section of the frame 4, and hence, there can be had also a considerable reduction in cost for the apparatus 2, i.e. a cost such as to chiefly favor the integrating of this principle into other already-existing presses.

For realizing the above, the first cylinder 17 of the device 14, is connected to the vertical rod 28 through a lever 37, the extremities of which are connected by the pivot 19 on the external surface of the first cylinder 17 and with the pivot on the vertical rod 28 of the frame 4. The lever 37 is disposed with a fixed stop-limit position on a special post 39 in the at rest position and in such positon relative to the movement of the means for divaricating prior to effecting operations on the collar 3. In these situations, the cylinder 17 can only pivot around the pivot 19.

When the operations are carried out on the collar 3, the reactions transmitted by the latter on the device 14 through the rod 21, cause a rotation of the lever 37 from the stop-limit position on the post 39 to a rotated position (with reference to FIG. 3) in the clock-wise sense, until the extremity 40 of the cylinder 17 is brought into contact and is stop-limited by the bar 41 of the press. A special threaded collar 42, used as a regulating system at the end 40 of the cylinder 17, establishes the at rest distance between cylinder 17 and upper horizontal bar 41 of the press.

The device 14 for the cutting means 15, is identical to the device for the divaricating and hence, for simplicity sake, the relative description has been omitted here.

Up to now, the apparatus 2 has been described and illustrated with respect to an indefinite number of cutting and divaricating means. However, the applicants believe that the optimum solution is obtained (from the viewpoint of an efficiency in removing the collar 3 and a simplicity of construction) with two divaricating means together with three actioning devices, and still further, the solution is also optimum with two knives and two divaricating means with four actioning devices.

Another solution will be described hereinafter. In this case, the apparatus 2 comprises—on a first vertical plane in which the axis of the press piston lies—two knives (of which only one is shown in FIG. 3), in positions that are symmetrical to one another with respect to the press action axis, and in a second vertical plane at 90° with respect to the first, two divaricators with thrusting surfaces 12 and 12' in positions symmetrical to one another and with respect to the axis of the press piston. Each one of the knives and of the divaricators are then connected to a device 14, as already described.

The frame 2, in the second solution, comprises a square cage (see FIG. 4) in which four sides are realized with four vertical rods 28, 43, 44 and 45 and four bars 29, 46, 47 and 48, radial to the piston 1 of the press, each bar being welded to a rod. On each one of the vertical rods 28, 43, 44 and 45, there is pivoted the lever 37 for connecting the first cylinder 17 of device 14, and on each bar, there is provided the second cylinder device 16 of the device 14.

Figure 4:
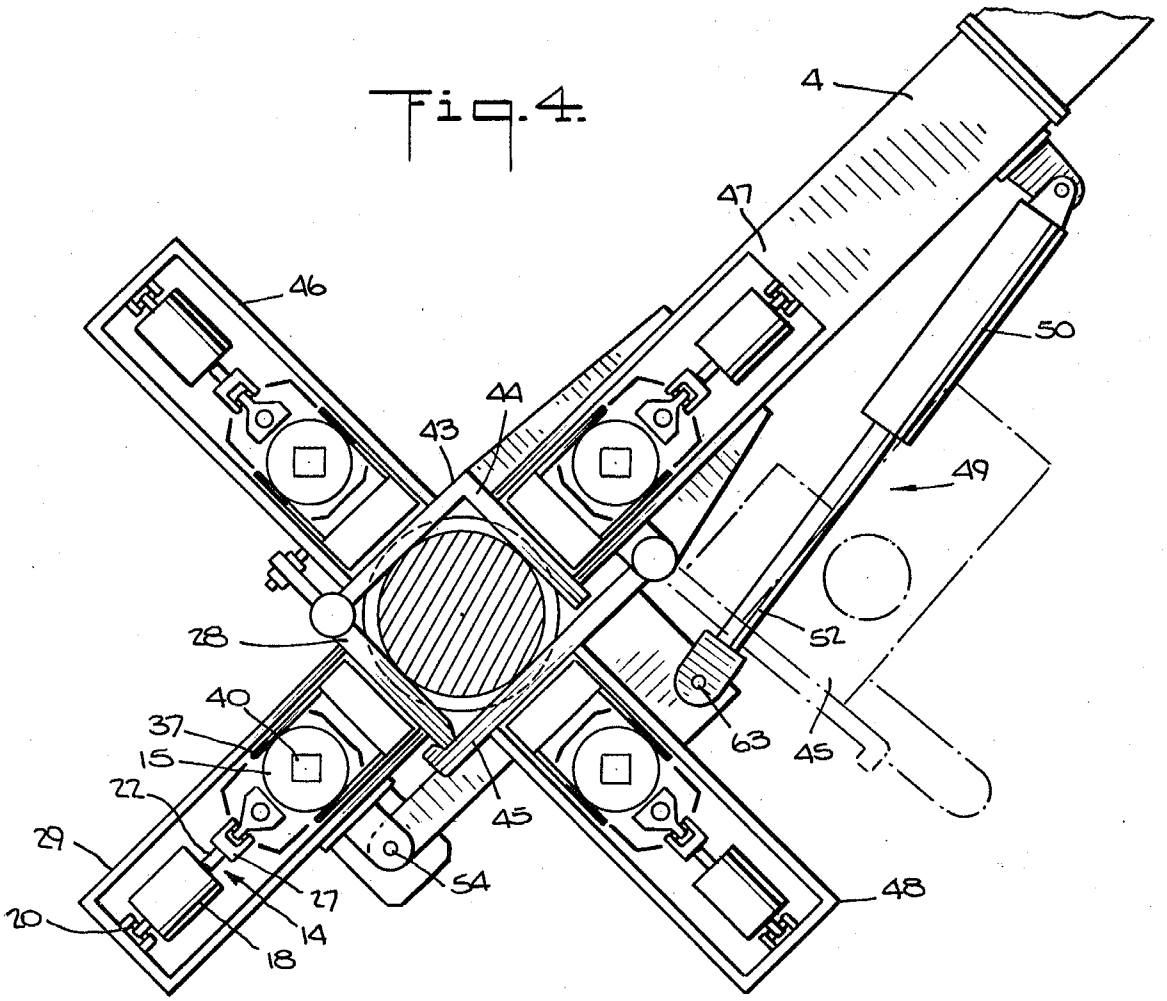
FIG. 4 is a top view, partly in cross-section, of a portion of the apparatus shown in FIG. 3.

The apparatus 2, also comprises opening and blocking means 49 for allowing, with the opening of one of the cage sides, the shifting of the entire frame 4 from a position external to the press to a position wherein the piston 1, extracted from the associated container C, is surrounded on the four cage sides by knives and divaricating means in their at rest position, as is shown in full-lines in FIG. 4.

Said opening and blocking means 49, in one of the many possible forms of realization, comprises a fluid-actuable control 50 having one extremity pivotally connected to the bar 47, and with the rod 52 associated with the openable side of the cage. In FIG. 3, this side is distinguished by the vertical rod with which one of the knives is associated. Said means comprise also a fluid-actuable control 53, attached to a part made fast with the bar 29, and adapted with the latch 54, for being inserted into a hole in the lever 55, which, in its turn, is moved, along with the cage opening, by the rod 52. This control 53 constitutes a safety block for the cage in its closed position around the piston 1 (FIG. 3).

Figure 5:
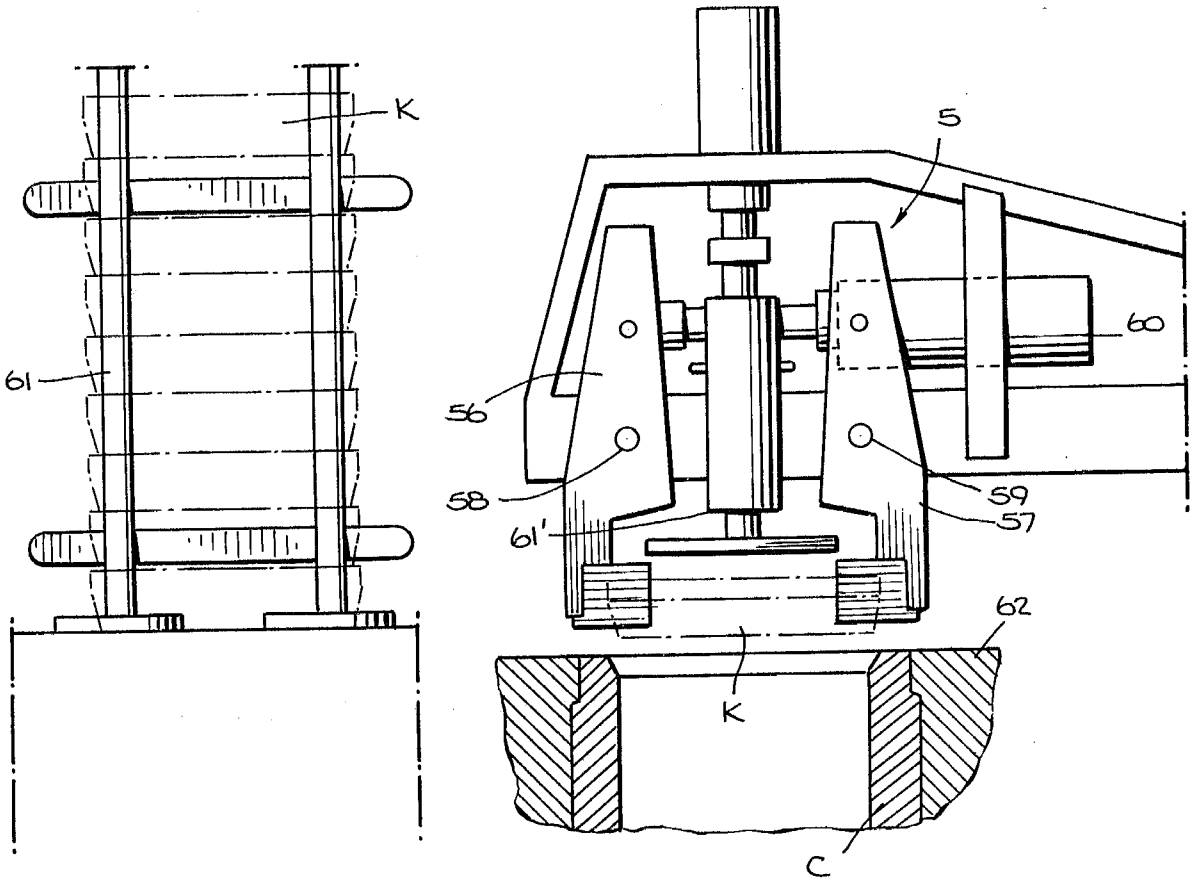
FIG. 5 is an enlarged, side elevation view of the disc loading and storage apparatus.

The apparatus 2, as already stated, forms part of a single complex that also comprises the loading group 5 and the positioning sealing discs (see FIG. 5). Therefore, there is obtained through this embodiment, the advantage of assembling into a reduced space and in a single structure, which rotates around the shaft 7 (see FIG. 1), all the auxiliary units for the continuous functioning of the press.

In particular, the loading group (FIG. 5) comprises two pincer arms 56 and 57 which are rotated around their pivots 58, 59, by means of the fluid-actuable control 60, the arms 56 and 57 being adapted to load the aluminum discs K which are removed from a special storage rack 61. The action of a further cylinder 61' determines the succeeding unloading and inserting of a disc K onto the loading plane or frusto-conical seat of the container 62.

The function of the group 6 apparatus and the disc loading apparatus is as follows:

(1) In a first step, when the piston 1 with its aluminum collar 3 is removed from its associated container C (FIG. 1), the group 6 is transported, with rotation around the shaft 7, from its at rest position outside of the press to the working position on the press. During this step the loading group (see FIG. 5) closes the pincer arms 56 and 57, over a disc K, and the apparatus 2 is in the working condition corresponding to the opened cage side of the frame 4, as is shown by broken-lines in FIG. 4.

(2) The rotation of the group 6 is stopped when the three sides of the cage, corresponding to the verticle rods 28, 43 and 44, surround the upper part of the piston 1, and the loading group 5 is disposed above the loading plane of the container 62 of the press with the center of disc K exactly aligned with the seat of the press container C (see FIG. 5).

(3) Thereupon, the fluid-actuable control of cylinder 61' is actuated which pushes the disc K into its seat in container C.

The successive sequences are those relative to the functioning of the apparatus 2, and they take place in the following further steps:

(I) First the fluid-actuable control 50 is actuated in such a way as to extend the rod 52 and to cause the cage to close by a rotation around the pivot (see FIGS. 3 and 4) of the bar 48 and the vertical rod, from the broken-line position to the full-line position of FIG. 4.

(II) When the fourth side of the cage has completed its rotation, the control 53 is actuated for thus obtaining, through the inserting of the latch 54 into the hole in lever 55, a blocking of the apparatus 2 around the piston 1, the results being shown in FIG. 3.

(III) Successively, the four devices 14 are activated (two of these devices being associated with knives, and two, with collar part divaricating means). During this step, two movements are had. The first of these movements is the descent of the said cutting and divaricating means, spaced apart and in the direction along the length of the piston 1, and the second movement is radially of the piston 1.

These two movements will now be described with reference to the device 14 and to the divaricator 12 (visible to the left of FIG. 3). The other movements, both of the divaricator 12' as well as of the two knives, take place in a similar manner. In particular, the first movement determines the passage of the divaricator from the full-line position "a" to the position "b"—shown with broken-lines. The second radial movement, from the position "b" to the position "c", is also shown with broken-lines.

As can be seen in FIG. 3, between the positions "a" and "b", the cylinder 17 rotates through a certain arc around the pivot 19 until the associated rod 21 extends. The position of the cylinder 15, and consequently, the inclination of the mid-line 13 of the divaricator 12, is maintained in the desired manner through the thrust exercised by the cylinder 18 rotating around the pivot 20. The supporting element 25, which is secured in fixed relation to the rod 21, now moves, and with it moves the rod 30 which, in sliding in the hole 33 of the slab 32 fixed to the cylinder 17, prevents any rotation of the rod 21 around its own axis.

Consequently, the cutting and divaricating means, when the lower extremity of the piston 1 is approached, are introduced into the inner space at the collar 3, with a pre-established inclination, i.e., in such a manner as to cut or to only make an incision in the thickness of the lateral wall of the collar 3, and to deepen the said cut or incision line into the thickness of the collar with the aid of the divaricators working symmetrically to one another and at a 90° plane with respect to the said cutting line.

In a second movement, the one radial to the piston 1 axis (between the positions "b" and "c") the cylinder 17, with its associated rod 21, rotates again around the pivot 19 until its axis becomes parallel to the axis of piston 1 with a corresponding sliding action of the rod 22 of the second cylinder 18.

During this step, the two knives penetrate deeper into the collar 3 thickness, and owing to the particular conformation of each knife, the two triangular faces 10 and 11 apply divaricating forces which are equal and contrasting, upon the two edges determined by the cut. Therefore, there are in each section transversal to the piston, two "V-shaped" openings, with their apexes or points of the "V" advancing in the radial sense and with the open area gradually increasing as the cutting line advances radially.

At the same time, the two divaricators also act in the radial direction, with fracturing between them along the two cutting lines, of the two halves of the collar 3 determined by the cut of the two knives.

The action of the two divaricators is particularly useful, since the thrusting surfaces 12 and 12' acting and being in contact, for a certain arc, with the inner wall of the collar 3 in two symmetrical positions and stretching in a uniform way the two half-shells that are still in a plastic state, help to maintain the two lines of the knife in the same vertical plane.

At the end of the last described step, the two half-shells (that have now been detached from each other) drop down—due to their weight, onto a special chute (not shown) in such a way as not to interfere with the loading group 5 for the discs K (FIG. 1).

Immediately after the removal of the collar 3, the piston 1, which is extracted from the container C can proceed with the further operations which were usually carried out manually in the past. For example, a provision can be made for the application, to special points of the frame 4, of one or several groups for delivering under pressure a lubricant around the thrusting end of the piston 1 for preventing any excessive adhesion between the collar 3 and the thrusting part of the piston 1.

Finally, when the collar 3 is detached, after all the preliminary operations of the successive press cycle have been completed, the devices 14 are actuated in the opposite sense to what was stated before, i.e., in such a manner as to bring the cutting and divaricating means into the conditions shown in FIG. 3, for example, the position "a" for the divaricator 12.

Successively, or simultaneously with, the preceeding step, the opening of one side of the cage is proceeded with by activating the means 50, and by this latter operation the complex constituted by the apparatus 2 and by the group for loading discs 5, can be drawn away from the press by a rotation around the shaft 7 (see FIG. 1) and taken back towards the at rest position.

From the explanation given of the working of the invention, the advantage of being possible to proceed with the removal of the collar 3 from the press piston 1, with pre-established sequences and quite automatically by having sequences without the drawbacks met with in the past, is self-evident. Thus, the drawbacks connected with the need for the manual intervention of one or more operators, who are obliged to work under extremely difficult ambiental conditions, are overcome.

In particular, the solution provided by the applicants, owing to the fact of the applying the reactions originated by the cut on the collar 3 onto the already existing structure of the press, is simple. Also, it offers to the manufacturers of presses what up to the present invention, the state of the art had not placed at their disposition, i.e., an apparatus for the removal of the collar 3 that proves, at the same time, to be of low cost and adapted for being integrated into already existing presses, but without involving any modifications and which guarantees for the press a functioning in a continuous and dependable way.

Although the present invention has been described in a particularly advantageous form of embodiment, it must be kept in mind that alternative embodiments will be apparent to those skilled in the art with knowledge of inventive principle. For example, the invention could be applied to a press which is different from the one illustrated in drawings provided that in the working of the different press, there is always present the phenomenon of forming the collar 3 in aluminum, or in any other similar material, when the piston is in the extrusion step, which collar is then extracted from its associated container.

It is, moreover, understandable how this apparatus for the removal of the collar 3 can be moved in ways that are different from those described. For example, it is possible to envision a shifting of the frame parallel to the press piston axis, from the top towards the bottom, and then, successively to translate the frame until the cutting and divaricating means are around the piston. Alternatively, it is possible to envision a simple translation.

In particular cases and for certain types of presses, it is also possible to position the apparatus for removing the collar 3, in the upper part and in a position co-axial to the press, and successively to shift the apparatus till it is in the desired position.

Although preferred embodiments of the present invention have been described and illustrated, it will be apparent to those skilled in the art that various modifications may be made without departing from the principles of the invention.

The embodiments of the invention in which an exclusive property or privilege is claimed are defined as follows:

1. In metal extruding apparatus comprising a piston for applying pressure to the metal to be extruded and in which a collar of the metal is formed around the lower end portion of the piston during the operation of the apparatus to extrude the metal, said collar having a portion of its interior wall which is farther from the piston end than the remainder thereof spaced from said piston, a method of removing the collar from the end of the piston which comprises:

cutting at least a portion of said collar along a line interiorly of said collar and in a direction extending from the end of the collar most remote from the piston end, said cutting being performed in the space between the collar and the piston; and applying divaricating forces to the interior of said collar commencing at said end of said collar and then, proceeding toward the other end of the collar and then, directing such forces radially outwardly of the piston to enlarge the smallest inner size of the collar to a size greater than the outer size of the piston whereby the collar is removed from the piston.

2. A method as set forth in claim 1 wherein the cutting and the divaricating forces are also applied radially outwardly of the piston as the cutting and the divaricating forces proceed from said end of the collar to the other end of the collar.

3. A method as set forth in claim 1 or 2 wherein said cutting is carried out along two lines lying in a plane containing the axis of said piston.

4. A method as set forth in claim 3 wherein said divaricating forces are applied along two lines lying in a plane containing the axis of said piston and which extends at an angle of 90° to the plane of the lines of cutting.

5. A method as set forth in claim 1 or 2 wherein the cutting line is V-shaped in cross section with the apex of the V most remote radially from the piston and wherein the divaricating forces are applied directly to the sides of the V-shaped line so as to spread apart portions of said collar at opposite sides of the line.

6. In metal extrusion apparatus comprising a piston for applying pressure to metal in a container for extruding the metal from the container and in which a collar of the metal is formed around the lower end portion of the piston during the extrusion process, said collar having a portion of its inner wall at the end thereof spaced from the free end of the piston also spaced from the exterior of the piston, apparatus for removing said collar from the piston when it is withdrawn from said container, said apparatus comprising:

a movable frame mounted for movement of a portion thereof toward and away from said piston and from a first position adjacent said piston to a second position spaced further from said piston than said first position;

cutting and divaricating means for cutting said collar and for applying forces thereto directed radially outwardly of the piston to divaricate the collar; and mounting and actuating means supporting said cutting and divaricating means from such portion of said frame, whereby said cutting and divaricating means may be moved adjacent to and away from said piston, said mounting and actuating means comprising means for moving said cutting and divaricating means in a direction parallel to the axis of said piston, from said end of said collar to the other end thereof and between the collar and said piston and for moving the divaricating portion of said cutting and divaricating means radially outwardly of said piston whereby the collar is cut and radially expanded by the cutting and divaricating means and is removed from said piston.

7. Apparatus as set forth in claim 6 wherein the cutting portion of said cutting and divaricating means comprises at least one cutting knife having a cutting edge which is inclined with respect to the axis of said piston and is farther from the piston axis at its end which is most remote from the free end of the piston than it is at its opposite end.

8. Apparatus as set forth in claim 7 wherein said cutting edge of the knife is formed by the intersection of two substantially flat, triangular faces.

9. Apparatus as set forth in claim 6 or 7 wherein the divaricating portion of said cutting and divaricating means comprises at least one thrusting means having a surface facing radially outwardly of the piston which is arcuate in a section taken transversely to the piston axis and which, in the direction of the piston axis, is inclined with respect to the piston axis, said surface being farther from the piston axis at its end most remote from the free end of the piston than it is at its opposite end.

10. Apparatus as set forth in claim 6 wherein said mounting and actuating means comprises a pair of fluid-actuable cylinder and piston means, each piston having a rod extending from an end of its associated cylinder, one said cylinder being pivotally mounted from said frame at its end opposite to the end thereof from which its piston rod extends with its axis inclined with respect to the piston axis and with the rod extending therefrom carrying means for cutting or divaricating said collar and the other said cylinder being pivotally mounted from said frame at its end opposite to end from which its piston rod extends, and connecting means pivotally interconnecting the last-mentioned piston rod with said one cylinder for causing the end of piston rod of said one cylinder to follow a path substantially parallel to the piston axis during the extension of the last-mentioned piston rod.

11. Apparatus as set forth in claim 10 wherein said connecting means comprises a support secured to said one cylinder, the piston rod of the other cylinder being pivotally connected to said support.

12. Apparatus as set forth in claim 11 further comprising guide means on said support slidably receiving the piston rod of said one cylinder for maintaining the means carried by the last-mentioned rod parallel to a plane containing the axis of the first-mentioned piston.

13. Apparatus as set forth in claim 12 wherein said one cylinder is secured to said support by a rod having one end thereof secured to said support, said rod extending parallel to the axis of said one cylinder, and by a slab fixedly secured to said one cylinder and having an opening therein in which the last-mentioned rod is slidably received.

14. Apparatus as set forth in claim 10 wherein the metal extrusion apparatus has a fixed member and wherein said one cylinder is pivotally mounted from said frame at its end opposite from the end thereof from which its piston rod extends by a link pivotally connected at one end to the one cylinder and pivotally connected at its other end to said frame, the last-mentioned end of said one cylinder being engageable with said fixed member.

15. Apparatus as set forth in claim 6 wherein said movable frame has four side members forming a square cage for receiving the first-mentioned piston between said members, one of said side members being pivotally connected to another side member to permit the cage to be opened and to permit movement of said frame toward and away from said first-mentioned piston, and wherein said cutting and divaricating means comprises a first cutting means mounted on a first one of said side members, a second cutting means mounted on a second one of the side members which is at the opposite side of the piston axis from said one side member, a first divaricating means mounted on a third one of said side members and a second divaricating means mounted on a fourth one of said side members which is at the opposite side of the piston axis from said third one of said side members.

16. Apparatus as set forth in claim 15 further comprising fluid-actuable cylinder and piston means interconnecting the one side member which is pivotally connected to another side member and another portion of said frame for pivoting said last-mentioned one side member.

17. Apparatus as set forth in claim 6 or 15 further comprising disc loading means on said frame for conveying a metal disc to a position beneath said piston.

18. Apparatus as set forth in claim 17 wherein said loading means comprises a pair of pivotable pincer arms for gripping a disc and fluid-actuable means for pivoting said arms.

19. Apparatus as set forth in claim 6 or 10 wherein said movable frame is pivotally mounted on a shaft having its axis parallel to the axis of the first-mentioned piston.

* * * * *